US007545334B2

(12) United States Patent
Iio

(10) Patent No.: US 7,545,334 B2
(45) Date of Patent: Jun. 9, 2009

(54) ANTENNA AND RECEIVER

(75) Inventor: Ken'ichi Iio, Nishinomiya (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 159 days.

(21) Appl. No.: 11/798,267

(22) Filed: May 11, 2007

(65) Prior Publication Data

US 2007/0262905 A1 Nov. 15, 2007

(30) Foreign Application Priority Data

May 12, 2006 (JP) ..... 2006-133539

(51) Int. Cl.
*H01Q 13/10* (2006.01)
*H01Q 1/48* (2006.01)

(52) U.S. Cl. ..... 343/770; 343/846

(58) Field of Classification Search ..... 343/846, 343/848, 700 MS, 767, 770
See application file for complete search history.

(56) References Cited

U.S. PATENT DOCUMENTS 5,539,420 A * 7/1996 Dusseux et al. ..... 343/769
5,661,493 A * 8/1997 Uher et al. ..... 343/700 MS
6,445,354 B1 9/2002 Kunysz
6,452,560 B2 9/2002 Kunysz

FOREIGN PATENT DOCUMENTS

JP 2000-77930 A 3/2000
JP 2005-203873 A 7/2005

* cited by examiner

*Primary Examiner*—Hoang V Nguyen
(74) *Attorney, Agent, or Firm*—Birch, Stewart, Kolasch & Birch, LLP

(57) ABSTRACT

It is an object of the present invention to provide an antenna capable of reducing a backside gain while keeping the sensitivity of overall antenna to a certain level. Particularly, in the case of an antenna subject to a circularly polarized wave, it is an object of the invention to provide an antenna capable of reducing the sensitivity of a left-handed circularly polarized wave more than ever before as well as keeping the sensitivity of a right-handed circularly polarized wave to a certain level. The antenna of the invention includes a plurality of ground conductors, a radiation conductor provided via a dielectric on a part of the above-mentioned ground conductor. The notch is formed on at least one of the above-mentioned ground conductors. The notch is formed outside of the area opposite to the above-mentioned radiation conductor.

9 Claims, 13 Drawing Sheets

ANTENNA AND RECEIVER

BACKGROUND OF THE INVENTION

1. Field of the Invention

The present invention relates to an antenna having low backside gain and multipath-resistant performance and a receiver using the antenna.

2. Description of the Related Art

For conventional receiving and broadcasting systems using satellites, microwave band radio waves passing through the ionosphere are used. One of the largest problems of the antenna when receiving such radio waves is enumerated as elimination of an influence of multipath.

When the antenna is disposed with its front panel faced in the direction toward the zenith, direct waves from the satellites (right-handed circularly polarized waves) fall from above a horizontal plane and do not enter from below the horizontal plane. Accordingly, it is one of the solutions for eliminating an influence of multipath that all radio waves entered from below the horizontal plane should be taken as reflected waves and such radio waves should not be received. However, in the case of the antenna using a patch antenna and so forth, since the antenna itself also has the sensitivity to the radio waves entered from the backside of the antenna, the antenna is under the great influence of multipath as it is. Therefore, in order to minimize the influence of multipath, reduction of backside gain of the antenna has been demanded so far.

Accordingly, in order to prevent from receiving the radio waves entered at low elevation angles or from below the horizontal plane, a patent document 1 discloses an antenna 100 as shown in FIG. 12. FIG. 12(A) is a perspective view of the antenna 100, and FIG. 12(B) is a sectional drawing of a cross section taken on line A-A in FIG. 12(A).

The antenna 100 comprises a dielectric 101, a radiation conductor 102, a ground conductor plate 103*a*, a ground conductor plate 103*b*, and a conductor wall 104. The radiation conductor is provided on the upper surface of the dielectric 101, and the ground conductor plate 103*a* with a bottom area larger than that of the dielectric 101 is provided on its underside. Furthermore, the ground conductor plate 103*b* is provided on the underside of the ground conductor plate 103*a* via the conductor wall 104. Thus, the antenna 100 has a choke structure. The conductor wall 104 is disposed, for example, at a distance of ¼ wavelength of a radio wave received, from edges of the ground conductor plate 103*b*. Since a radio wave entered from behind can be trapped by this choke structure, it is possible to reduce the influence of multipath on the antenna 100.

Besides, an antenna 200 as shown in FIG. 13 is disclosed in patent documents 2 and 3. FIG. 13(B) is a bottom plan view, and FIG. 13(A) is an end elevation of a cross section taken on line A-A in FIG. 13(B).

The antenna 200 comprises a ground conductor plate 204 having a dielectric 201, a radiation conductor 202, and notches 203. The radiation conductor 202 is provided over almost all area on the upper surface of the dielectric 201, and the ground conductor 204 is provided over almost all area on the underside except for the portions corresponding to the notches 203. Furthermore, the notches 203 are formed nearly in the center of four sides of the ground conductor plate 204.

According to such a configuration, the notches 203 allow a pathway length of the induction current flowing across the outer circumferential edge to be elongated, out of the induction current induced in the ground conductor plate 204, without preventing a main flow of induction current crossing over the center portion. Therefore, it is possible to raise an F-to-B ratio (the ratio of the front side gain to the backside gain) by weakening downward radiation attributable to induction current induced in the ground conductor plate 204.

[Patent document 1] JP-A-2000-77930

[Patent document 2] JP-A-2005-203873

[Patent document 3] Japanese Patent No. 3764289

However, the antenna 200 described in the patent documents 2 and 3 not only can raise the F-to-B ratio, but also brings about a problem of reducing the sensitivity of overall antenna 200. That is to say, since electric current flows much into the ground conductor plate 204 immediately below the radiation conductor 202, the notches 203 provided on the ground conductor plate 204 may serve to reduce the sensitivity of overall antenna. Besides, in the case of a circularly polarized wave antenna, not only the sensitivity of a left-handed circularly polarized wave is reduced, but the sensitivity of a right-handed circularly polarized wave is also reduced more than necessary.

Furthermore, since the notches 203 provided on the ground conductor plate 204 immediately below the radiation conductor 202 cause the antenna 200 to change the frequency characteristics or directional pattern, modification of basic design itself of the antenna 200 may be required to compensate for the above-mentioned change. This problem leads to a fundamental problem that radio waves sent from satellites and so forth cannot be received properly.

The invention is devised to solve these problems, and it is an object of the invention to provide an antenna capable of reducing the backside gain while keeping the sensitivity of overall antenna to a certain level. Particularly, in the case of an antenna subject to a circularly polarized wave, it is an object of the invention to provide an antenna capable of reducing the sensitivity of a left-handed circularly polarized wave more than ever before as well as keeping the sensitivity of a right-handed circularly polarized wave to a certain level. This allows an influence of multipath, which is harmful when receiving signals from satellites and so forth, to be reduced more than ever before.

It is a further object of the invention to provide an antenna, which causes little variation of the frequency characteristics or directional pattern of the antenna as well as requiring no modification of basic design for their compensation, when reducing the sensitivity of the left-handed circularly polarized wave.

SUMMARY OF THE INVENTION

In order to solve the above-mentioned problems, the antenna of the invention is characterized by comprising a plurality of ground conductors, a radiation conductor provided via a dielectric on a part of the above-mentioned ground conductor, and characterized in that a notch is formed on at least one of the above-mentioned ground conductors and that the notch is formed outside of the area opposite to the above-mentioned radiation conductor.

Furthermore, the above-mentioned antenna is characterized in that a conductor wall is provided between at least one of the above-mentioned ground conductors and that the above-mentioned conductor wall and the above-mentioned ground conductors provided with the conductor wall constitute a choke structure.

Furthermore, the above-mentioned antenna is characterized in that the above-mentioned ground conductors are disposed in parallel in the nearly vertical direction and that the above-mentioned notch is provided on the above-mentioned ground conductor placed on top.

Furthermore, the above-mentioned antenna is characterized in that the above-mentioned notch is formed with the longitudinal direction of the notch headed from the radiation conductor side to the outside edges of the ground conductor.

Furthermore, the above-mentioned antenna is a patch antenna and characterized in that the above-mentioned notch is in the shape of a polygon or a wavy slot.

Besides, in order to solve the above-mentioned problems, the antenna of the invention is characterized by including a plurality of ground conductors, the radiation conductor provided via the dielectric on a part of the above-mentioned ground conductors, the conductor wall provided between at least one of the ground conductors, characterized in that the above-mentioned conductor wall and the above-mentioned ground conductors constitute a choke structure, that the notch is formed on at least one of the above-mentioned ground conductors, and that the notch serves to increase an amount of radiation of radio waves radiated in the above-mentioned choke structure.

Besides, in order to solve the above-mentioned problems, a receiver of the invention is characterized by including the antenna, characterized in that the above-mentioned antenna includes a plurality of ground conductors, a radiation conductor provided via the dielectric on a part of the ground conductor, the radiation conductor provided via the dielectric on a part of the ground conductor, that the notch is formed on at least one of the above-mentioned ground conductors, and that the notch is formed outside of the area opposite to the above-mentioned radiation conductor.

DETAILED DESCRIPTION OF AN ILLUSTRATIVE EMBODIMENT

Embodiment 1

Figure 1:
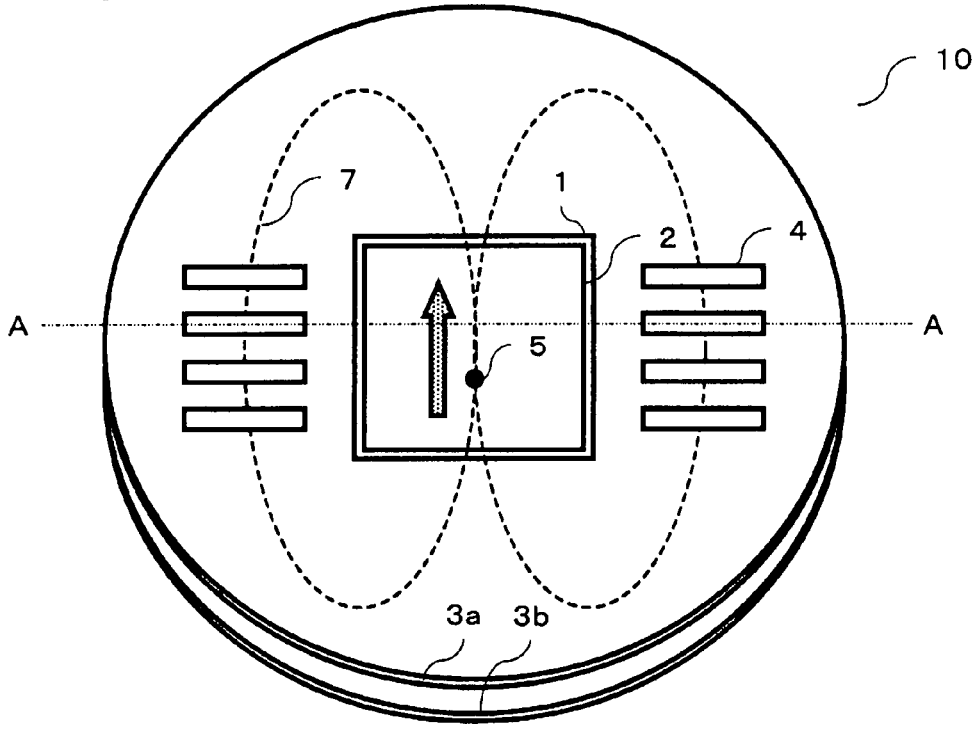
FIG. 1A and 1B are views showing an example of a configuration of an antenna according to the embodiment 1 of the invention.
Figure 1:
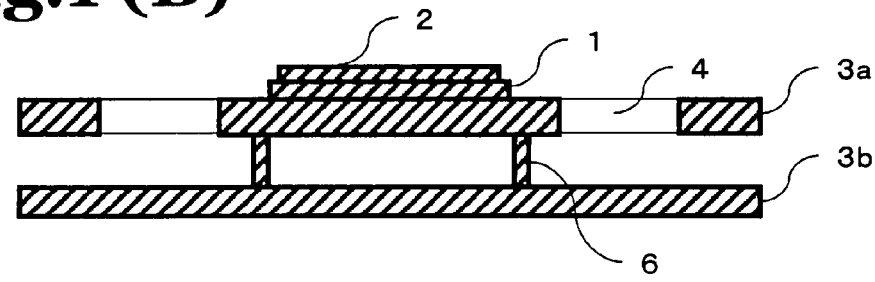

Hereinafter, an embodiment 1 of the invention is described by referring to the drawings.

FIG. 1 is a view showing an example of a configuration of the antenna 10 in the embodiment 1 of the invention. FIG. 1(A) is a perspective view of the antenna 10, and FIG. 1(B) is a sectional drawing of a cross section taken on line A-A in FIG. 1(A).

An antenna 10 is a linear polarized wave antenna, comprising a dielectric 1, a radiation conductor 2, a ground conductor 3*a* having notches 4, a ground conductor 3*b*, a conductor wall 6. Here, the dielectric 1, the radiation conductor 2, and the ground conductor 3*a* are stacked in due order from above and disposed so that each center position coincides. Besides, the radiation conductor 2 is provided with a single feeding point 5. This feeding point 5 is provided so that the direction of the induction current 7 induced in the ground conductor 3*a* is as indicated by an arrow in FIG. (1). Furthermore, the conductor wall 6 is provided between the ground conductors 3*a* and 3*b*, and these constitute a choke structure.

The ground conductor 3*a* is wider than an area of base of the dielectric 1 and the radiation conductor 2, and the notches 4 are formed outside of the area opposite to the radiation conductor 2. These notches 4 are rectangular slots, four notches are formed in parallel and nearly symmetrically on both sides of the radiation conductor 2, respectively. Besides, the notches 4 are formed with their longitudinal direction headed from the radiation conductor 2 to the outside edges of the ground conductor 3*a*. The above-mentioned configuration allows the backside gain to be reduced while keeping the sensitivity of overall antenna to a certain level, thus increasing the F-to-B ratio higher than ever before. Furthermore, details are described later using FIG. 6.

Figure 2:
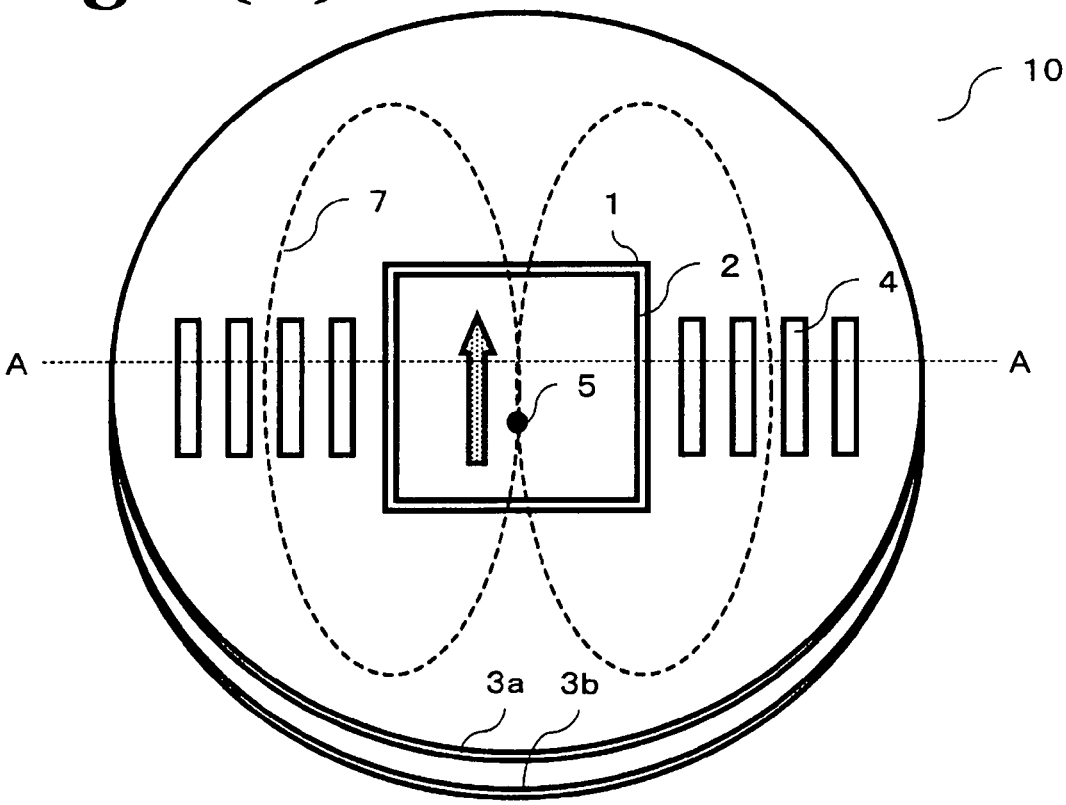
FIG. 2A and 2B are views showing an example of a configuration of an antenna according to the embodiment 1 of the invention.
Figure 2:
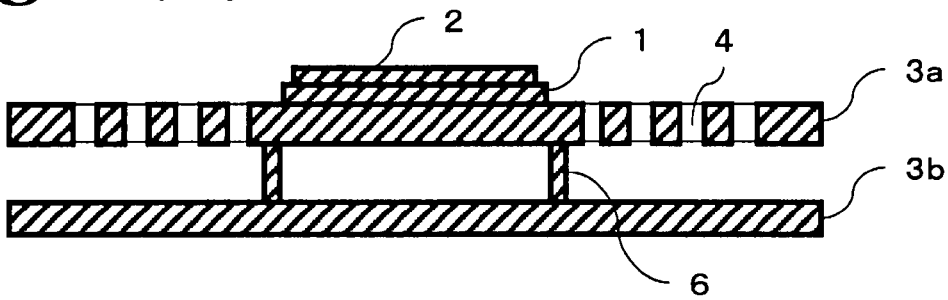
Figure 3:
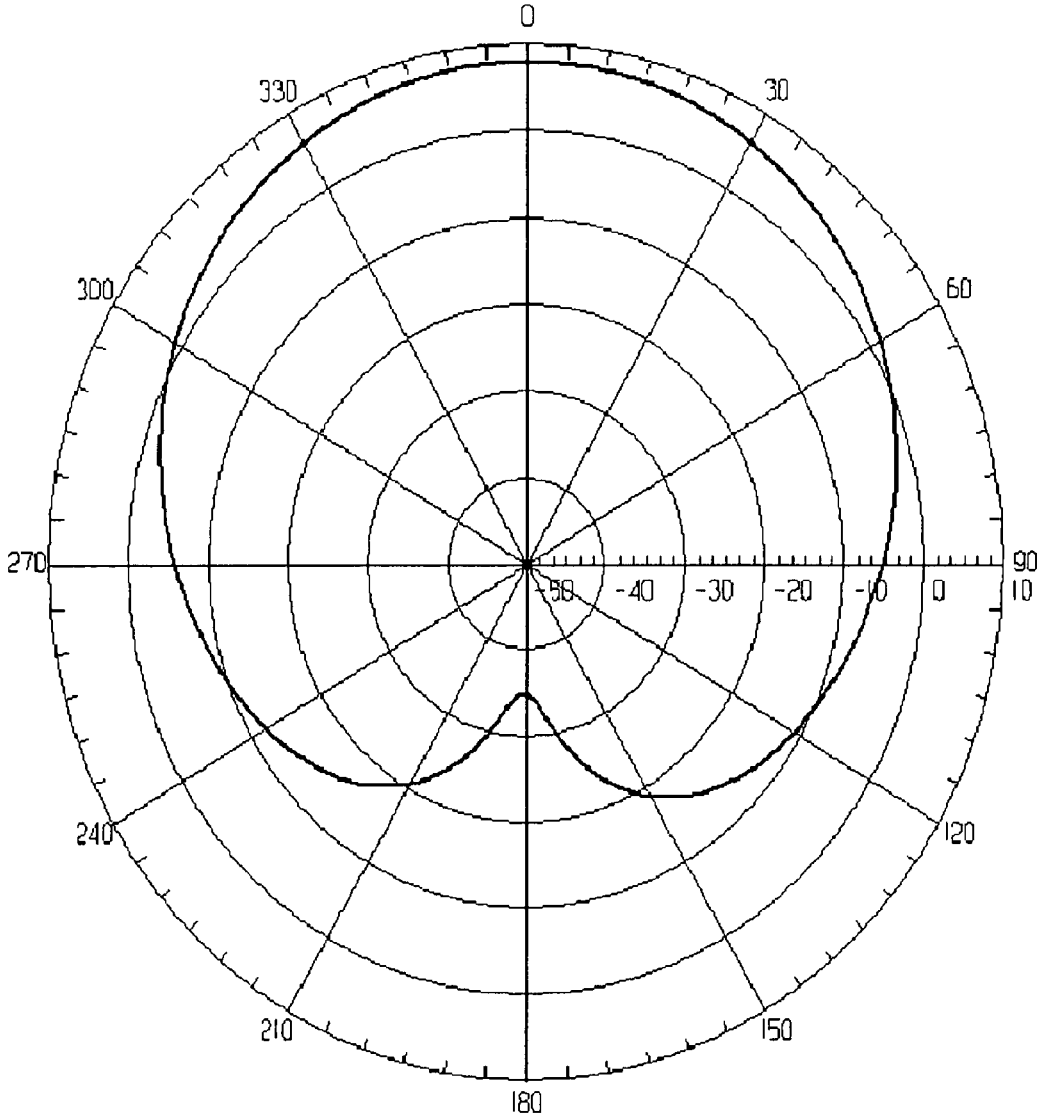
FIG. 3 is a view showing the result of simulation when notches are formed on the ground conductor according to the embodiment 1 of the invention.
Figure 4:
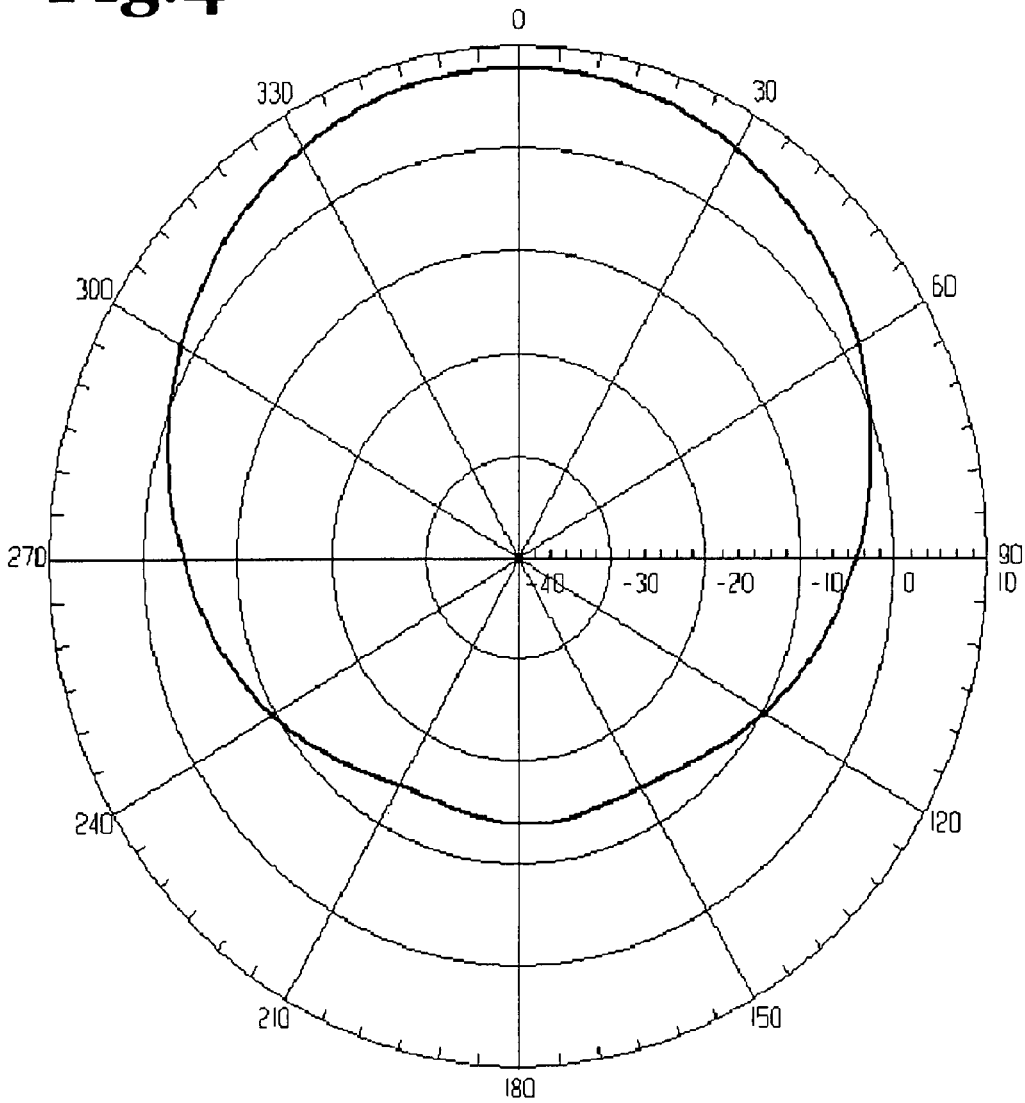
FIG. 4 is a view showing the result of simulation when notches are formed on the ground conductor according to the embodiment 1 of the invention.
Figure 5:
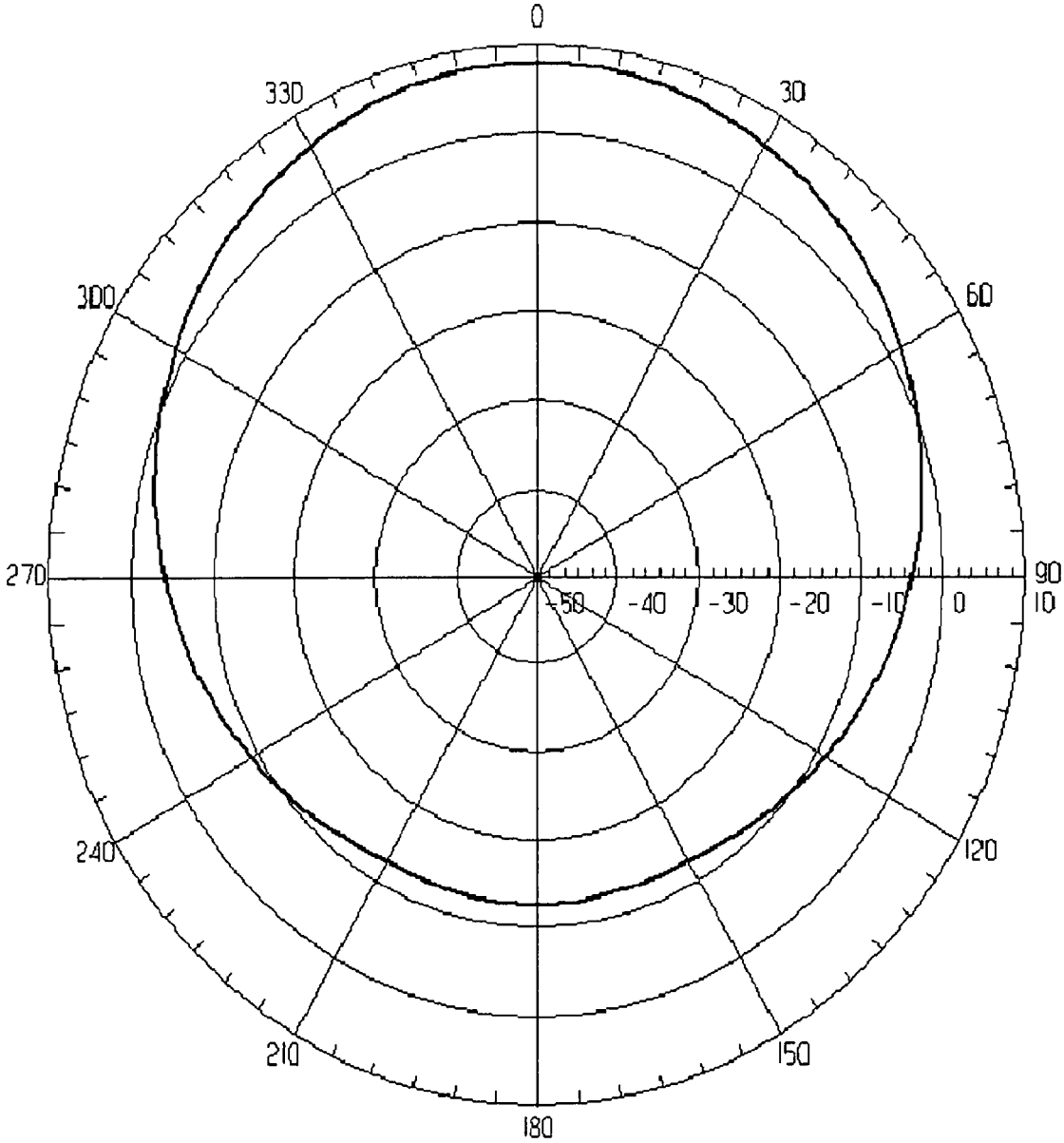
FIG. 5 is a view showing the result of simulation when notches are not formed on the ground conductor according to the embodiment 1 of the invention.

Next, in the antenna 10 according to the embodiment 1 of the invention, far-field analysis is made using a three-dimensional field simulator. FIG. 3 shows the result of simulation for calculation of directional characteristics. Besides, in contrast, the result of simulation is shown in FIG. 4 when the notches 4 are arranged in parallel from the radiation conductor 2 to the ground conductor 3*a* as shown in FIG. 2. Furthermore, the result of simulation when the notches 4 are not provided is shown in FIG. 5. In FIGS. 3 to 5, the circumferential direction indicates a direction angle and the radial direction indicates the strength of radiation. Besides, since reversibility works out in regard to the antenna property, the strength of radiation according to the result of simulation can be taken as reception of the antenna.

In reference to the above-mentioned simulation, the dielectric 1 is a 51.3 mm square, the radiation conductor 2 has relative permittivity of 3.27, thickness of 1.6 mm and is a 55.0 mm square. Besides, the ground conductor plates 3*a* and 3*b* are circles of 115.0 mm in diameter with thickness of 0.8 mm. Besides, the feeding point 5 is located along a perpendicular line by 8.0 mm apart from the center of the dielectric 1. The induction current 7 flows in the direction marked by an arrow in FIG. 1(A). Furthermore, the notches 4 are rectangular slots of 2.0 mm in width and 20.0 mm in length and located at intervals of 5.0 mm.

As shown by the result of simulation in FIGS. 3 to 5, the sensitivity at near 180° in FIG. 4 is lower than that in FIG. 5, and/or the sensitivity at near 180° in FIG. 3 is lower than that in FIG. 4. That is to say, it is understood that the notches 4 provided on the ground conductor 3*a* allow the backside gain of the antenna 10 to be reduced. Furthermore, it is found that the backside gain can further be reduced when the notches 4 are formed with its longitudinal direction headed from the radiation conductor 2 to the outside edges of the ground conductor 3*a*.

Figure 6:
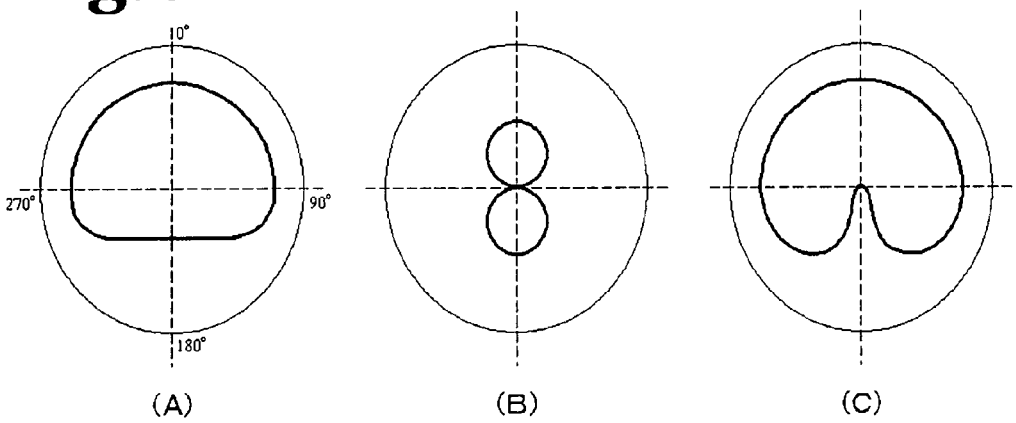
FIG. 6 is a view qualitatively showing the directional characteristics of an antenna according to the embodiment 1 of the invention.

Next, physical property is described by referring to FIG. 6. In addition, FIG. 6(A) is a view qualitatively showing the directional pattern of the radio waves radiated from the radiation conductor, FIG. 6(B) is a view qualitatively showing the directional pattern of the radio waves excited in the choke structure, and FIG. 6(C) is a view qualitatively showing the directional pattern of the radio waves radiated from overall antenna (that is, synthesis of (A) and (B)). Besides, since reversibility works out in regard to the antenna property, the radiation property in FIG. 6 can be taken as reception characteristic.

In regard to the antenna 10 as shown in FIG. 1, directional characteristics can be represented as shown in FIG. 6(A) when attention is focused only on the radio waves radiated from the radiation conductor 2. When a part of the radio waves radiated from the radiation conductor 2 emits around the outside of the ground conductor 3*a*, a radio wave is newly excited on the choke portion disposed on the underside of the antenna 10.

For example, when the conductor wall 6 is provided at a distance of quarter wavelength from the edges of the ground conductor 3*a*, the radio waves excited by this choke portion has high directional characteristics only to the vertical direction as shown in FIG. 6(B). In addition, when the conductor wall 6 is provided at a distance shorter than quarter wavelength from the edges of the ground conductor 3*a*, the directional characteristics spreading in the horizontal direction more than that as shown in FIG. 6(B) can be obtained.

Figure 12:
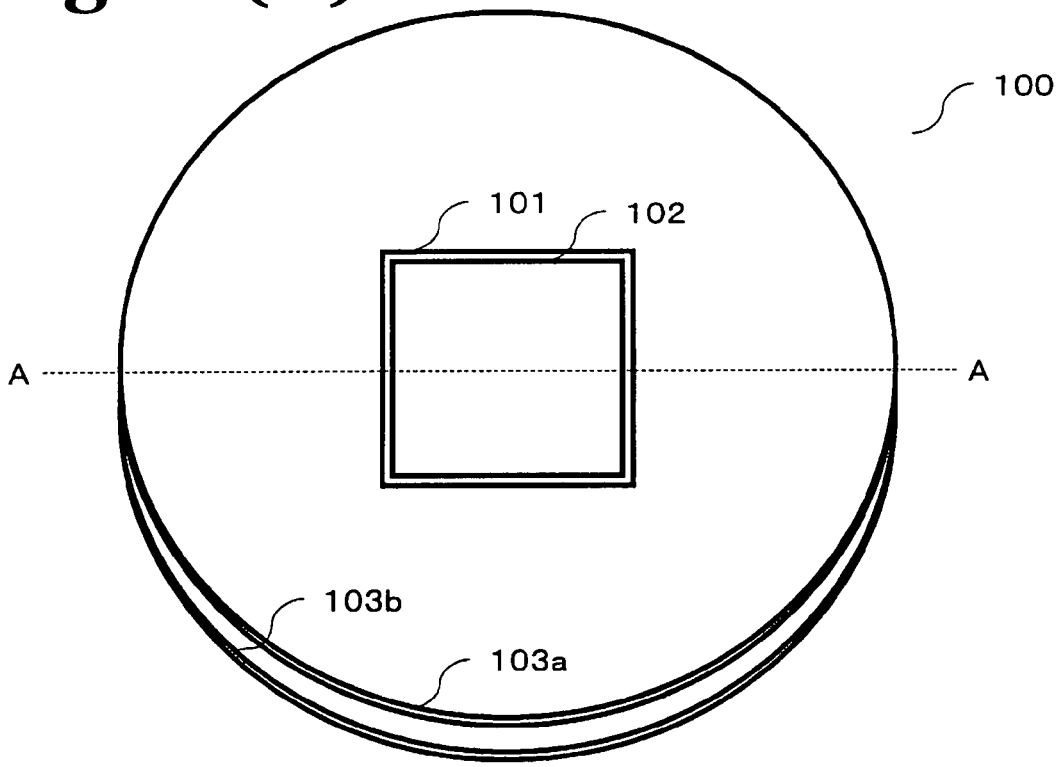
FIG. 12A and 12B are views showing an example of a configuration of a conventional antenna.
Figure 12:
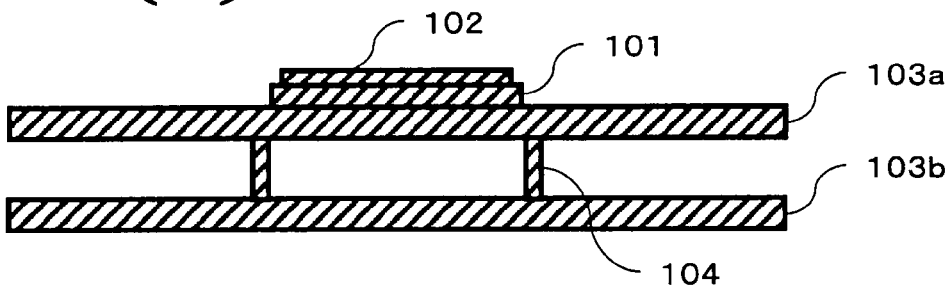
Figure 13:
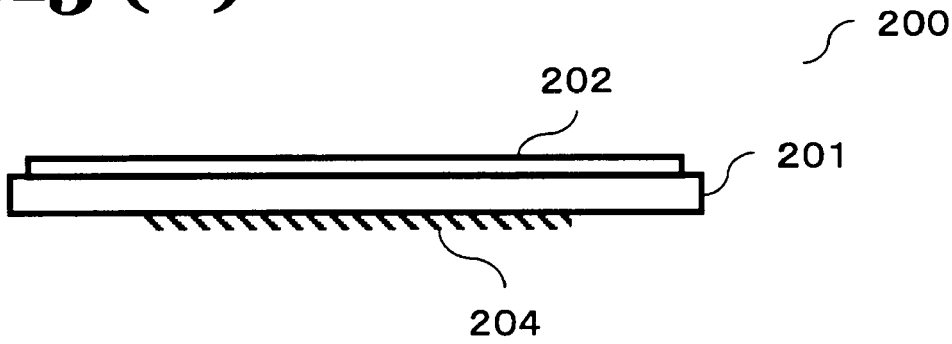
FIG. 13A and 13B are views showing an example of a configuration of a conventional antenna.
Figure 13:
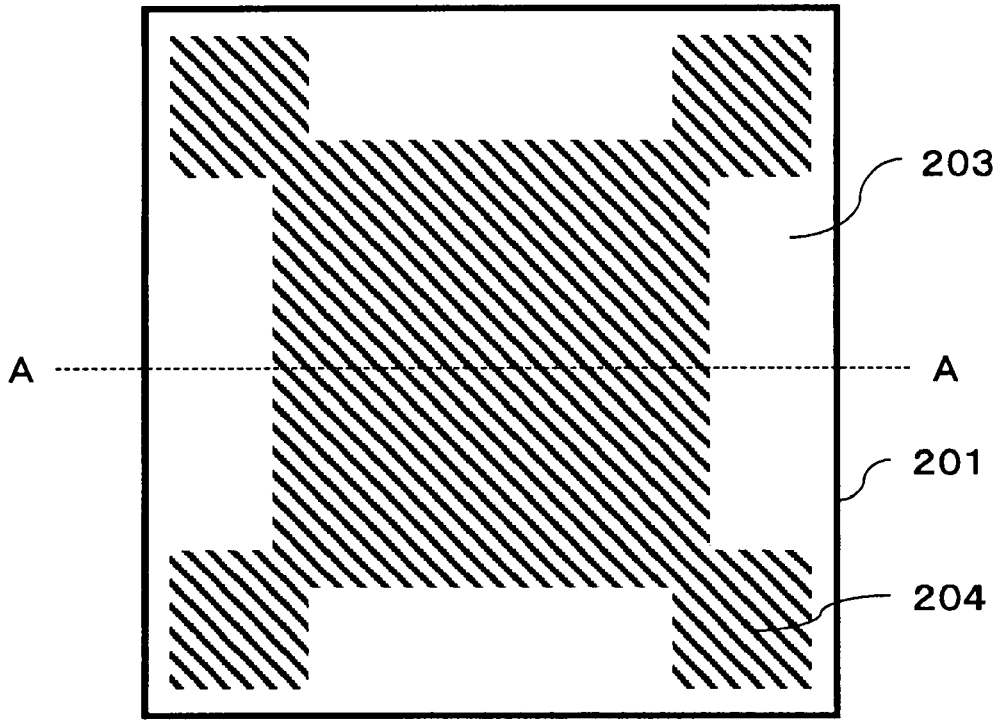

When the radio wave excited by the choke portion is in reverse phase as against the radio wave radiated from the radiation conductor 2, it is possible to suppress radiation of the radio waves in the vertical direction of overall antenna 10. In the conventional apparatus as shown in FIG. 12, however, since there was less amount of radiation of the radio waves excited by the choke portion (hereinafter referred to as amount of suppression), it was not possible to obtain sufficient amount of suppression.

Therefore, the notches 4 are provided outside of the area opposite to the radiation conductor 2 on the ground conductor 3*a* to increase an amount of radiation of the radio waves to be radiated into the underside of the ground conductor 3*a*. That is to say, the radio waves radiated from the radiation conductor 2 are also radiated through the notches 4 into the choke structure in addition to radiation emitted around the edges of the ground conductor 3*a*. Accordingly, since the amount of suppression at the choke portion can be increased, it is possible to reduce the backside gain while keeping the sensitivity of overall antenna 10 to a certain level. In addition, an increase of an amount of radiation of the radio waves is the same meaning as strengthening the electric field intensity in that area.

Besides, this amount of suppression can be increased more effectively when the notches 4 are formed with its longitudinal direction headed from the radiation conductor 2 to the outside edges of the ground conductor 3*a* as shown in FIG. 1 than when the notches 4 are formed as shown in FIG. 2. That is, it is possible to increase an amount of suppression at the choke portion more effectively by forming the notches 4 perpendicularly to the direction of the induction current 7 induced on the ground conductor 3*a* than by forming them in parallel. Furthermore, since the directional characteristics of the radio waves excited at the choke portion can also be changed depending on the position where the conductor wall 6 is provided, it is possible to easily suppress radiation of the radio waves in the horizontal direction of the antenna 10.

As mentioned above, the antenna of the invention can reduce the backside gain more than ever before by providing the notches outside of the area opposite to the radiation conductor on the ground conductor. Furthermore, it is also possible to curtail material cost or reduce weight of the antenna by providing the notches.

In addition, in reference to the antenna of the invention, similar effect can also be obtained by providing the notches on at least one ground conductor. Besides, the notches themselves may be either wavy slots or slits with the notches formed up to the edges of the ground conductor, instead of rectangular slots. Particularly, since an area of a notch can grow larger than that of a rectangular slot as against an area of base of the ground conductor when wavy slots are provided, it is possible to obtain higher effects. Besides, the choke structure may be formed by providing at least any one of the ground conductors with the conductor wall.

Embodiment 2

Hereinafter, an embodiment 3 of the invention is described by referring to the drawings. For the configuration similar to the embodiment 1, explanation is omitted.

Figure 7:
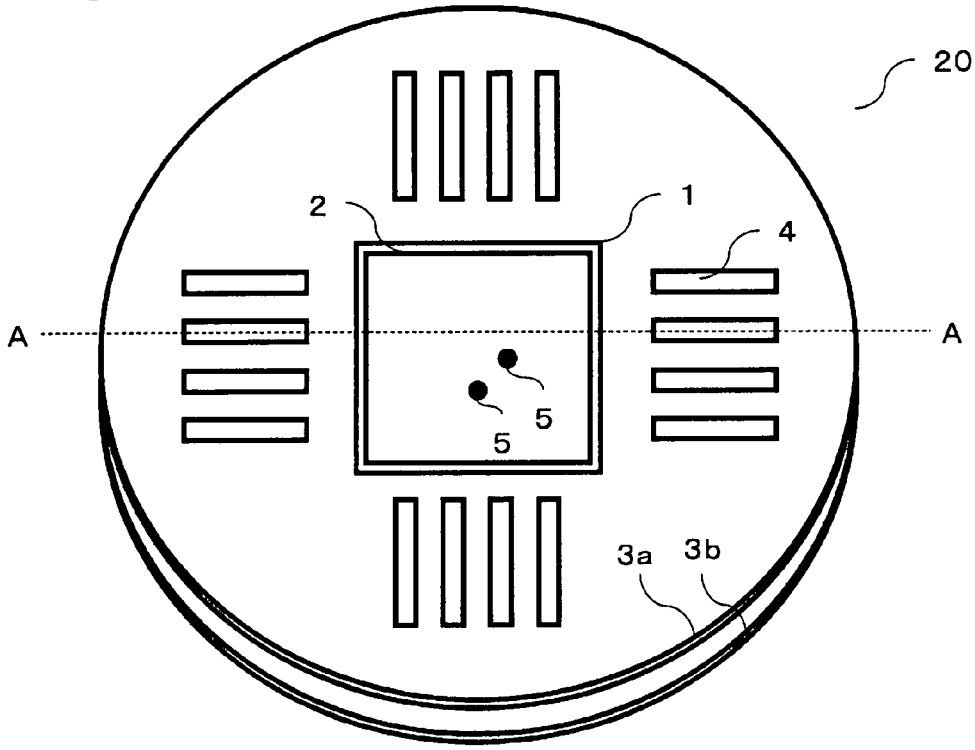
FIG. 7A and 7B are views showing an example of a configuration of an antenna according to the embodiment 2 of the invention.
Figure 7:
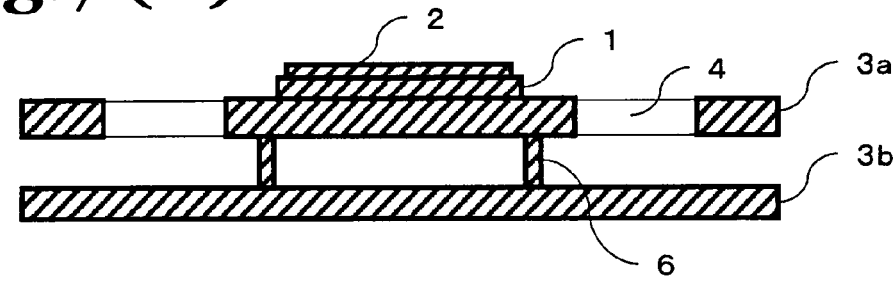

FIG. 7 is a view showing an example of the configuration of an antenna 20 in the embodiment 2 of the invention. FIG. 7(A) is a perspective view of the antenna 20, and FIG. 7(B) is a sectional drawing of a cross section taken on line A-A in FIG. 7(A). The antenna 20 is a circularly polarized wave antenna for performing two-point feeding, and the position of the notches 4 provided on the ground conductor 3*a* differs from that of the antenna 10 according to the embodiment 1 of the invention.

As shown in FIG. 7, two feeding points 5 are provided on the radiation conductor 2. One is the feeding point in the embodiment 1 in FIG. 1 and another feeding point 5 is further added by turning the feeding point 5 in the embodiment 1 as shown in FIG. 1 by 90°. In addition, the notches 4 are further added by turning the notches 4 in the embodiment 1 as shown in FIG. 1 with respect to the center of the radiation conductor 2 by 90°. The notches 4 are rectangular slots, four notches are formed in parallel and nearly symmetrically on both sides of the radiation conductor 2, respectively. Besides, the notches 4 are formed with their longitudinal direction beaded from the radiation conductor 2 to the outside edges of the ground conductor 3*a*. Providing such notches 4 allows an amount of suppression to be adjusted similar to the embodiment 1, a gain of a right-handed circularly polarized wave to be kept to a certain level, and a backside gain of a left-handed circularly polarized wave to be reduced more than ever before.

Figure 8:
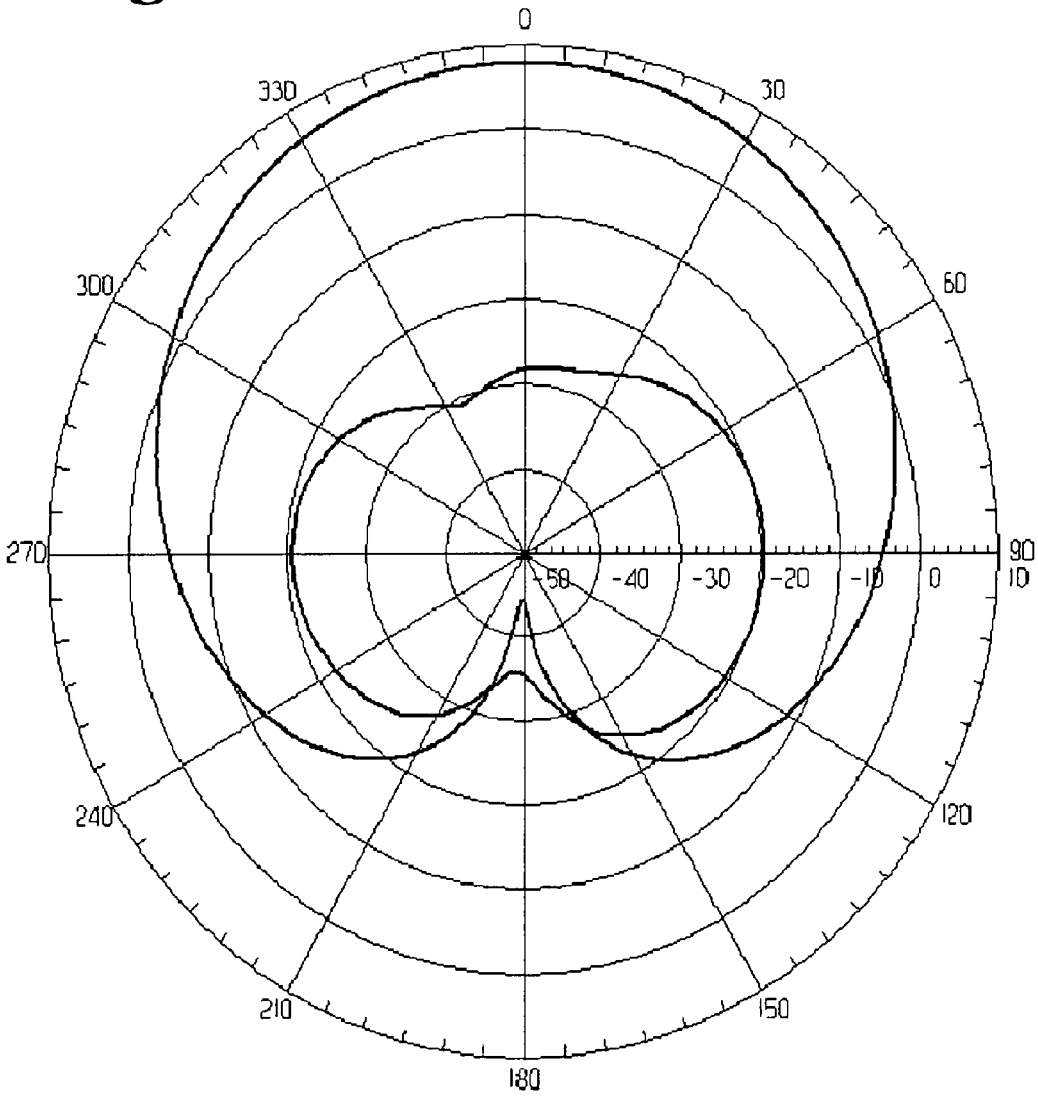
FIG. 8 is a view showing the result of simulation when notches are formed on the ground conductor according to the embodiment 2 of the invention.
Figure 9:
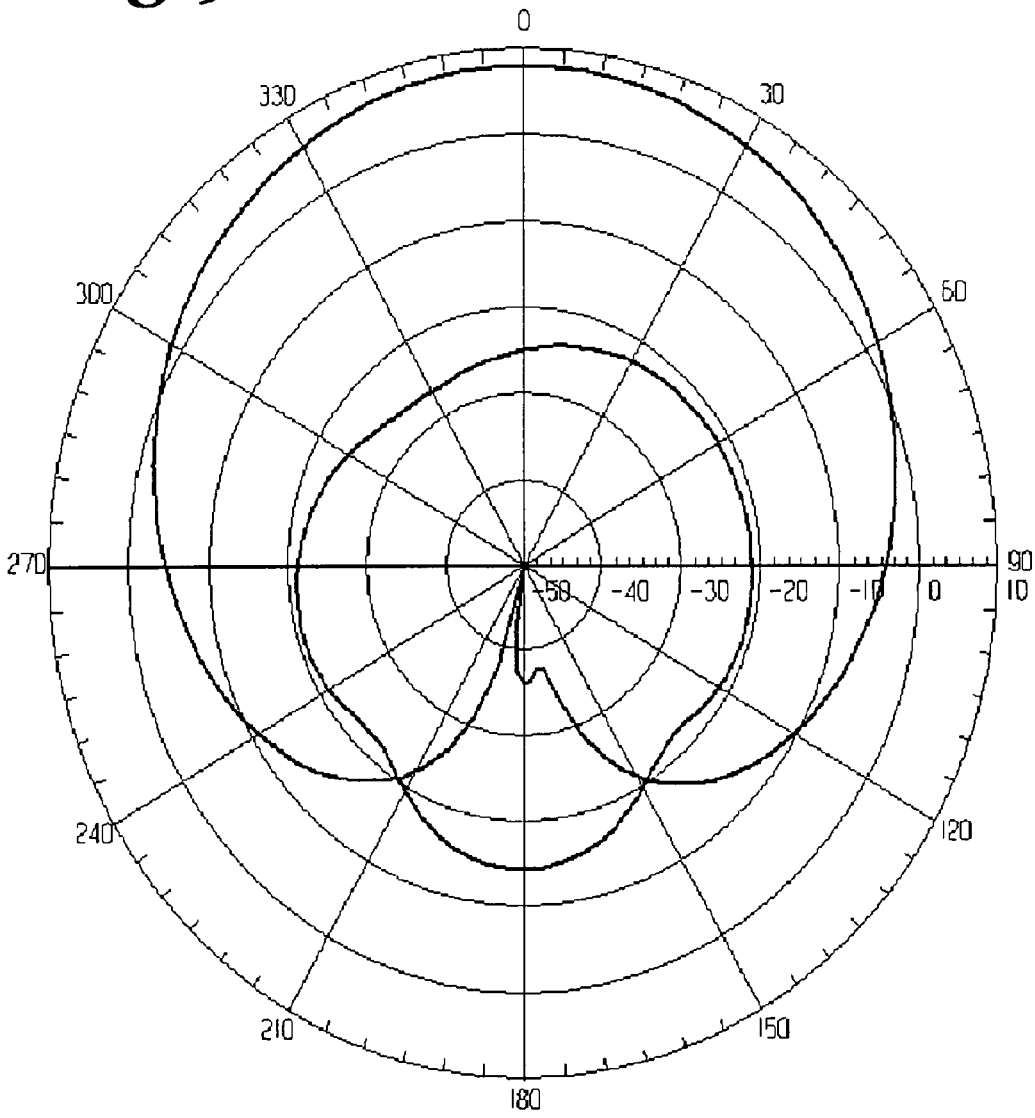
FIG. 9 is a view showing the result of simulation when notches are not formed on the ground conductor according to the embodiment 2 of the invention.

Next, in the antenna 20 according to the embodiment 2 of the invention, a far-field analysis is made using a three-dimensional field simulator. FIG. 8 shows the result of simulation for calculation of the directional characteristics. Besides, in contrast, the result of simulation when the notches 4 are not provided is shown in FIG. 9. A line plotted nearly outside in FIGS. 8 and 9 represents the directional characteristics of the right-handed circularly polarized wave, and a line plotted nearly inside represents the directional characteristics of the left-handed circularly polarized wave. In FIGS. 8 and 9, the circumferential direction indicates a direction angle and the radial direction indicates the strength of radiation. In addition, each value set by the simulation is similar to each value set in the embodiment 1.

As shown by the result of simulation in FIGS. 8 and 9, the sensitivity of the left-handed circularly polarized wave at near 180° as the result of simulation in FIG. 8 is lower than that in FIG. 9. However, the sensitivity of the right-handed circularly polarized wave does not change that much. That is to say, it is understood that the notches 4 provided on the ground conductor 3*a* allow the backside gain of the left-handed circularly polarized wave to be reduced than ever before while keeping the sensitivity of the right-handed circularly polarized wave to a certain level.

Figure 10:
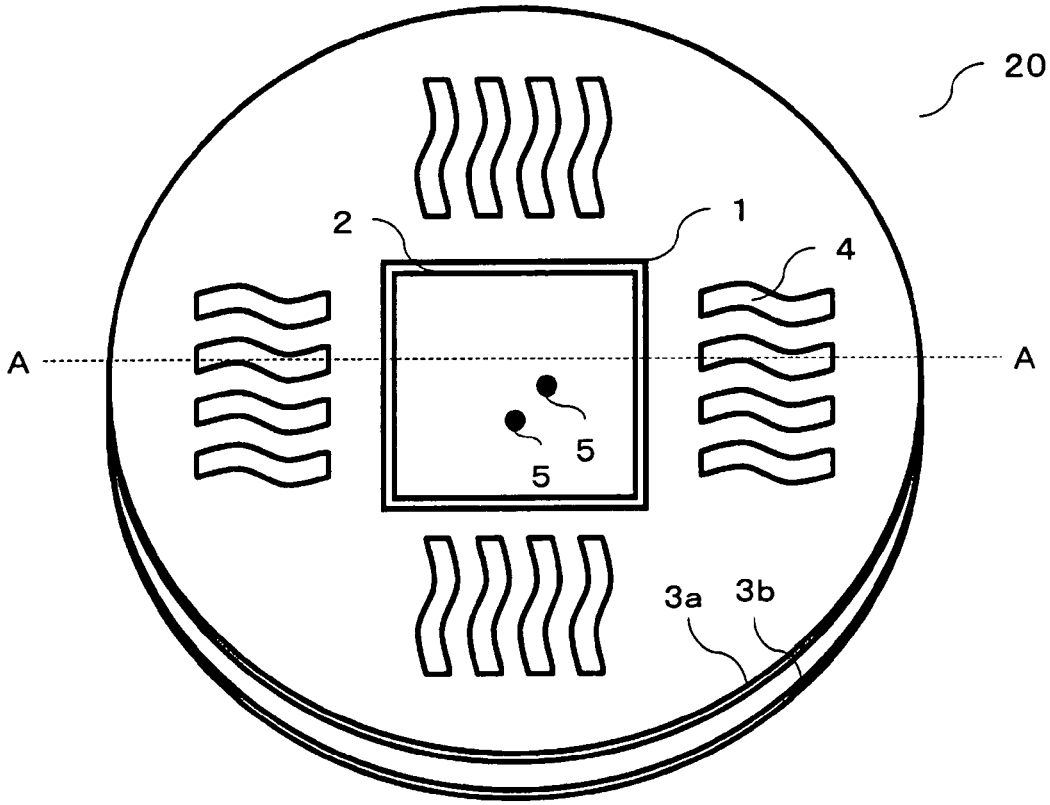
FIG. 10A and 10B are views showing an example of a configuration of an antenna according to the embodiment 2 of the invention.
Figure 10:
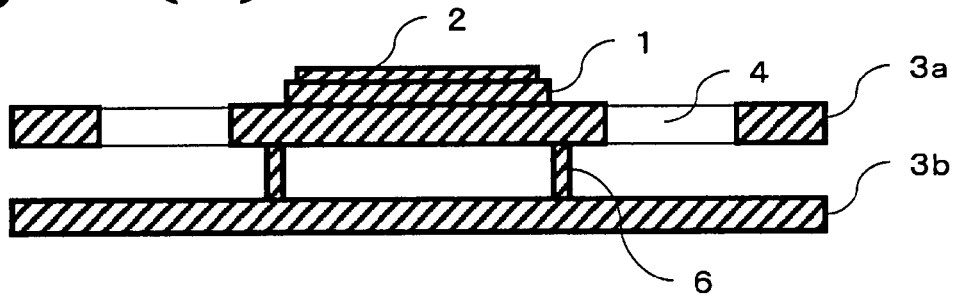

In addition, the physical property in the embodiment 2 can be considered similar to the physical property described in the embodiment 1. Therefore, a larger effect can be produced when the notches 4 are formed with their longitudinal direction headed from the radiation conductor 2 to the outside edges of the ground conductor 3*a*. That is, it is possible to increase the amount of suppression at the choke portion more effectively by forming the notches 4 perpendicularly to the direction of the induction current induced on the ground conductor 3*a*. Besides, a configuration in the case of wavy slots used as other form of notches 4 is shown in FIG. 10.

Embodiment 3

Hereinafter, an embodiment 3 of the invention is described by referring to the drawings. For the configuration similar to the embodiment 1, explanation is omitted.

Figure 11:
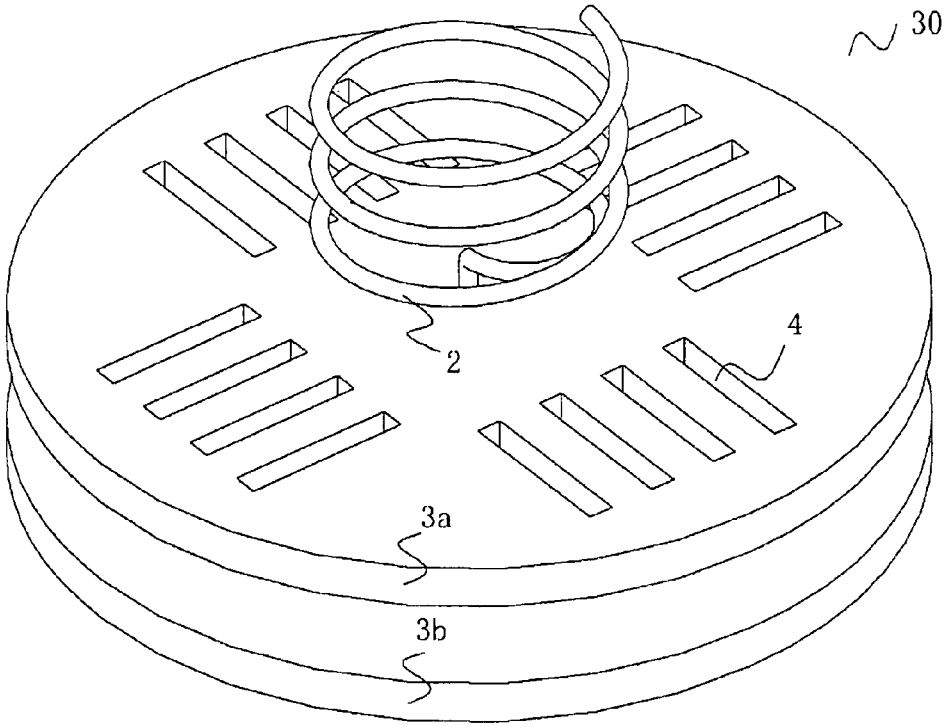
FIG. 11A and 11B are views showing an example of a configuration of an antenna according to the embodiment 3 of the invention.
Figure 11:
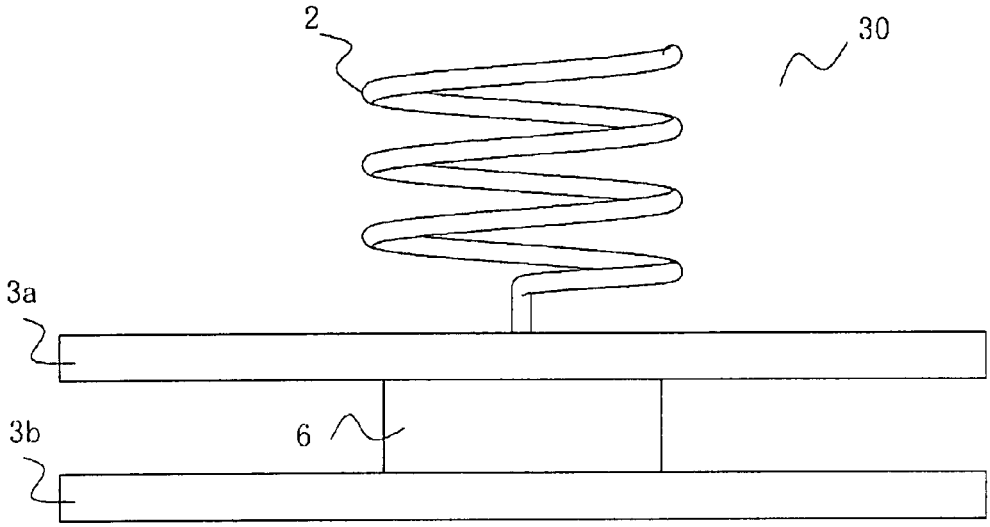

FIG. 11 is a view showing an example of the configuration of an antenna 30 in the embodiment 3 of the invention. In addition, FIG. 11(A) is a perspective view of the antenna 30, and FIG. 11(B) is its side elevation view. The antenna 30 is a helical antenna, so the embodiment 3 differs from the embodiments 1 and 2 of the invention described above about the configuration of the patch antenna.

The antenna 30 comprises a radiation conductor 2, a ground conductor 3*a* having notches 4, a ground conductor 3*b*, a conductor wall 6. Now, the radiation conductor 2 is formed as a helix with the same center as the ground conductor 3*a*. In addition, there exists an air gap between the radiation conductor 2 and the ground conductor 3*a*.

Besides, the notches 4 are rectangular slots and formed outside of the area opposite to the radiation conductor 2 on the ground conductor 3*a*. That is, the notches 4 are provided outside of the projection area (in the vertical) from the radiation conductor 2 on the ground conductor 3*a*. In addition, the notches 4 are formed nearly symmetrically with respect to a point constituting the center of the radiation conductor 2.

This configuration allows a helical antenna such as antenna 30 to reduce the backside gain.

Finally, the antenna of the invention is implemented in a receiver which utilizes signals received by the antenna. For example, the receiver includes a receiver used for INMARSAT (international Maritime Satellite Organization) and a GPS compass.

ADVANTAGE OF THE INVENTION

According to the antenna of the invention, in the case of a linear polarized wave antenna, the notches formed outside of the area opposite to the radiation conductor on the ground conductor allow thee backside gain to be reduced while keeping the sensitivity of overall antenna to a certain level, thus increasing the F-to-B ratio higher than ever before. Besides, the frequency characteristics or directional pattern of the antenna varies little in such a case. Furthermore, the notches formed also make it possible to curtail material cost or weight of the antenna.

Besides, in the case of a circularly polarized wave antenna, it is possible to reduce the backside gain of the left-handed circularly polarized wave more than ever before while keeping the sensitivity of the right-handed circularly polarized wave to a certain level. Therefore, it is possible to provide the antenna with higher multipath resistant performance than ever before.

I claim:

1. An antenna comprising:

a plurality of ground conductors;

a radiation conductor which is provided via a dielectric on a part of the ground conductor; wherein at least one notch is formed on at least one of the ground conductors; and the notch is formed outside of the area opposite to the radiation conductor; wherein at least one conductor wall is provided between the ground conductors; and the conductor wall and the ground conductors constitute a choke structure.

2. The antenna as set forth in claim 1:

wherein the plurality of ground conductors are disposed in parallel in the nearly vertical direction; and the notch is provided on top of the ground conductors.

3. The antenna as set forth in claim 2:

wherein the antenna is a patch antenna; and the notch is in the shape of a polygon or a wavy slot.

4. The antenna as set forth in claim 1:

wherein the notch is formed with the longitudinal direction of the notch headed from the radiation conductor side to the outside edges of the ground conductor.

5. The antenna as set forth in claim 4:

wherein the antenna is a patch antenna; and the notch is in the shape of a polygon or a wavy slot.

6. The antenna as set forth in claim 1:

wherein the antenna is a patch antenna; and the notch is in the shape of a polygon or a wavy slot.

7. The antenna as set forth in claim 1:

wherein the antenna is a patch antenna; and the notch is in the shape of a polygon or a wavy slot.

8. An antenna comprising:

a plurality of ground conductors;

a radiation conductor which is provided via a dielectric on a part of the ground conductor;

at least one conductor wall which is provided between the ground conductors;

wherein the conductor wall and the ground conductors constitute a choke structure;

at least one notch is formed on at least one of the ground conductors; and the notch serves to increase radiation of radio waves radiated in the choke structure.

9. A receiver comprising:

an antenna;

wherein the antenna comprises:

a plurality of ground conductors;

a radiation conductor which is provided via a dielectric on a part of the ground conductor;

wherein at least one notch is formed on at least one of the ground conductors; and the notch is formed outside of the area opposite to the radiation conductor, wherein at least one conductor wall is provided between the ground conductors; and the conductor wall and the ground conductors constitute a choke structure.

* * * * *